US010410783B2

(12) United States Patent
Kudo et al.

(10) Patent No.: US 10,410,783 B2
(45) Date of Patent: Sep. 10, 2019

(54) COIL COMPONENT

(71) Applicant: Murata Manufacturing Co., Ltd., Kyoto (JP)

(72) Inventors: Hayami Kudo, Nagaokakyo (JP); Yoshimasa Yoshioka, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/400,464

(22) Filed: Jan. 6, 2017

(65) Prior Publication Data

US 2017/0213639 A1 Jul. 27, 2017

(30) Foreign Application Priority Data

Jan. 21, 2016 (JP) ..... 2016-009985

(51) Int. Cl.

| | |
|---|---|
| ***H01F 5/00*** | (2006.01) |
| ***H01F 27/29*** | (2006.01) |
| ***H01F 27/28*** | (2006.01) |
| ***H01F 17/00*** | (2006.01) |
| ***H01F 27/36*** | (2006.01) |

(52) U.S. Cl.

CPC ..... *H01F 27/292* (2013.01); *H01F 17/0013* (2013.01); *H01F 27/2804* (2013.01); *H01F 27/365* (2013.01)

(58) Field of Classification Search

USPC ..... 336/192

See application file for complete search history.

(56) References Cited

U.S. PATENT DOCUMENTS

| | | | | |
|---|---|---|---|---|
| 5,583,424 | A * | 12/1996 | Sato | G05F 1/575 323/282 |
| 2008/0189968 | A1* | 8/2008 | Schletti | G01B 7/107 33/501.4 |
| 2015/0318104 | A1* | 11/2015 | Chang | H01F 17/0013 333/185 |
| 2016/0254086 | A1* | 9/2016 | Kim | H01F 17/0013 336/61 |
| 2017/0111995 | A1* | 4/2017 | Nishikawa | H01F 27/255 |
| 2017/0162317 | A1* | 6/2017 | Taniguchi | H01F 27/2804 |

FOREIGN PATENT DOCUMENTS

| | | |
|---|---|---|
| JP | 2011-091097 A | 5/2011 |
| JP | 2014-013815 A | 1/2014 |

OTHER PUBLICATIONS

An Office Action mailed by the Japanese Patent Office dated Aug. 21, 2018, which corresponds to Japanese Patent Application No. 2016-009985 and is related to U.S. Appl. No. 15/400,464.

* cited by examiner

*Primary Examiner* — Ronald Hinson

(74) *Attorney, Agent, or Firm* — Studebaker & Brackett PC

(57) ABSTRACT

A coil component having a first surface and a second surface facing each other, including a coil conductor formed into a spiral shape, a magnetic resin body disposed on the first surface side of the coil conductor without being disposed on the second surface side of the coil conductor, a first external terminal and a second external terminal disposed on at least one surface on the first surface side of the magnetic resin body and electrically connected to the coil conductor, and at least one dummy terminal disposed on at least one surface on the first surface side of the magnetic resin body without being electrically connected to the coil conductor.

13 Claims, 14 Drawing Sheets

COIL COMPONENT

CROSS REFERENCE TO RELATED APPLICATIONS

This application claims benefit of priority to Japanese Patent Application 2016-009985 filed Jan. 21, 2016, the entire content of which is incorporated herein by reference.

TECHNICAL FIELD

The present disclosure relates to a coil component.

BACKGROUND

Conventional coil components include a coil component described in Japanese Patent Publication No. 2014-13815. This coil component has a substrate, upper and lower spiral conductors disposed on upper and lower surfaces of the substrate, an upper magnetic resin body covering the upper side of the upper spiral conductor, a lower magnetic resin body covering the lower side of the lower spiral conductor, and a first external terminal and a second external terminal disposed on an upper surface of the upper magnetic resin body.

SUMMARY

Problem to be Solved by the Disclosure

The following problem was found when it was attempted to actually mount the conventional coil component on a mounting board. When the first external terminal and the second external terminal of the coil component are disposed on the mounting board, and the first external terminal and the second external terminal are fixed to the mounting board by solder, a positional displacement of the coil component occurs in a horizontal direction or a rotational direction relative to the mounting board. As a result of intensive studies, the present inventors found out that this is caused because the coil component is supported at two points of the first external terminal and the second external terminal.

Therefore, a problem to be solved by the present disclosure is to provide a coil component capable of reducing a positional displacement of the coil component in the horizontal direction and the rotational direction relative to the mounting board when the coil component is mounted on the mounting board.

Solutions to the Problems

To solve the problem, a coil component of the present disclosure is a coil component having a first surface and a second surface facing each other, comprising:

a coil conductor formed into a spiral shape;

a magnetic resin body disposed on the first surface side of the coil conductor without being disposed on the second surface side of the coil conductor;

a first external terminal and a second external terminal disposed on at least one surface on the first surface side of the magnetic resin body and electrically connected to the coil conductor; and at least one dummy terminal disposed on at least one surface on the first surface side of the magnetic resin body without being electrically connected to the coil conductor.

According to the coil component of the present disclosure, the first external terminal and the second external terminal as well as the at least one dummy terminal are disposed on at least one surface on the first surface side of the magnetic resin body. As a result, when the first surface of the coil component is mounted on a mounting board, the coil component can stably be supported at at least three points by disposing the first external terminal and the second external terminal as well as the at least one dummy terminal on the mounting board. Therefore, when the coil component is mounted on the mounting board by solder etc., a positional displacement of the coil component can be reduced in the horizontal direction and the rotational direction relative to the mounting board.

In an embodiment of the coil component, the magnetic resin body is disposed on the entire surface on the first surface side of the coil conductor.

According to the embodiment, since the magnetic resin body is disposed on the entire surface on the first surface side of the coil conductor, the magnetic resin body can suppress a magnetic flux leakage from the first surface of the coil component.

In an embodiment of the coil component, the first surface is a mounting surface that is a side mounted on a mounting board, and the second surface is a detecting surface that is a side facing a detected conductor.

According to the embodiment, since the first surface is the mounting surface, the magnetic resin body is disposed on the mounting surface side of the coil conductor. As a result, the magnetic resin body can suppress a magnetic flux leakage from the mounting surface of the coil component. Therefore, when the mounting surface of the coil component is mounted on the mounting board, the magnetic flux leakage to the mounting board side of the coil component can be suppressed to acquire a desired inductance. Additionally, by suppressing the magnetic flux leakage to the mounting board side of the coil component, the magnetic coupling to a wiring and another electronic component disposed on the mounting board can be suppressed to acquire a desired resonance operation. As a result, a wiring and an electronic component can be arranged in the vicinity of the coil component so as to achieve a reduction in size of the mounting board on which the coil component is mounted.

On the other hand, since the second surface is the detecting surface, the magnetic resin body is not disposed on the detecting surface side of the coil conductor. As a result, the magnetic resin body does not interfere with the generation of the magnetic field from the detecting surface of the coil component. Therefore, when the detecting surface of the coil component is allowed to face the detected conductor, the magnetic resin body does not interfere with the generation of the magnetic field to the detected conductor side of the coil component and does not reduce the sensitivity of the detection of the detected conductor by using the coil component.

In an embodiment of the coil component, when viewed in a direction orthogonal to the first surface, a gravity center of the first surface is included in a region formed by connecting respective gravity centers of the first external terminal, the second external terminal, and all the dummy terminals.

According to the embodiment, since the gravity center of the first surface is included in the region formed by connecting the respective gravity centers of the first external terminal, the second external terminal, and all the dummy terminals, the coil component can be disposed on the mounting board in a more stable posture. Therefore, the positional displacement of the coil component can further be reduced in the horizontal direction and the rotational direction relative to the mounting board.

In an embodiment of the coil component, when viewed in a direction orthogonal to the first surface, the first external terminal, the second external terminal, and all the dummy terminals are located outside the inner surface of the coil conductor.

The inner surface of the coil conductor refers to only the inner side surface of the innermost circumference of the spiral of the coil conductor.

According to the embodiment, since the first external terminal, the second external terminal, and all the dummy terminals are located outside the inner surface of the coil conductor, the first external terminal, the second external terminal, and all the dummy terminals do not overlap with the inner magnetic path of the coil conductor. Therefore, since the magnetic flux generated in the inner magnetic path is not blocked by the dummy terminals, the efficiency of acquisition of the L-value of the coil component can be restrained from decreasing.

In an embodiment of the coil component, when viewed in a direction orthogonal to the first surface, the first external terminal, the second external terminal, and all the dummy terminals have a sum of areas of portions overlapping with the outside of the outer surface of the coil conductor larger than a sum of areas overlapping with the inside of the outer surface of the coil conductor.

The outer surface of the coil conductor refers to only the outer side surface of the outermost circumference of the spiral of the coil conductor.

According to the embodiment, since the first external terminal, the second external terminal, and all the dummy terminals have the sum of areas of portions overlapping with the outside of the outer surface of the coil conductor larger than the sum of areas overlapping with the inside of the outer surface of the coil conductor, a stray capacitance can be reduced in a portion from the first external terminal, the second external terminal, and all the dummy terminals to the coil conductor. Additionally, SRF (Self-Resonant Frequency) can be made higher.

In an embodiment of the coil component, when viewed in a direction orthogonal to the first surface, the respective areas of the first external terminal, the second external terminal, and all the dummy terminals are the same as each other.

According to the embodiment, since the respective areas of the first external terminal, the second external terminal, and all the dummy terminals are the same as each other, a solder wetting amount can be made equal between the terminals when the coil component is mounted on the mounting board, and an inclination of the coil component relative to the mounting board can be suppressed.

In an embodiment of the coil component, when viewed in a direction orthogonal to the first surface, a shape of at least one of the first external terminal, the second external terminal, and all the dummy terminals is different from the shape of the other terminals.

According to the embodiment, since the shape of at least one of the first external terminal, the second external terminal, and all the dummy terminals is different from the shape of the other terminals, the at least one terminal can be used as a directional marker and the directionality of the coil component can be recognized. Therefore, when the coil component is mounted onto the mounting board, the first external terminal and the second external terminal can easily be connected to corresponding signal lines.

In an embodiment of the coil component, when viewed in a direction orthogonal to the first surface, the respective shapes of the first external terminal, the second external terminal, and all the dummy terminals on the outer circumferential side of the first surface are the same as each other.

The shapes of the terminals on the outer circumferential side of the first surface refer to the shapes of the terminals in the portions facing the outer shape of the first surface.

According to the embodiment, since the respective shapes of the first external terminal, the second external terminal, and all the dummy terminals on the outer circumferential side of the first surface are the same as each other, when the coil component is mounted on the mounting board, the stress applied to the terminals can be made uniform and the inclination of the coil component relative to the mounting board can be suppressed. Additionally, since an external pressure applied to the terminals can be made uniform, the fixation strength of the coil component to the mounting board can be ensured.

In an embodiment of the coil component, the first external terminal, the second external terminal, and all the dummy terminals are disposed on only the one surface of the magnetic resin body.

According to the embodiment, since the first external terminal, the second external terminal, and all the dummy terminals are disposed on only the one surface of the magnetic resin body, all the terminals can be accommodated on the one surface of the magnetic resin body. As a result, when all the terminals are fixed by solder to the mounting board, wetting and spreading of the solder can be suppressed on the lateral sides of the coil component and, consequently, the mounting area of the coil component can be reduced.

In an embodiment of the coil component, the number of the dummy terminals is at least two;

when viewed in a direction orthogonal to the first surface, the shape of the outer circumferential side of the first surface is a quadrangle; and four terminals out of the first external terminal, the second external terminal, and all the dummy terminals are respectively located at the four corners of the first surface.

According to the embodiment, since four terminals out of the first external terminal, the second external terminal, and all the dummy terminals are respectively located at the four corners of the first surface, the stress applied to the terminals can be made uniform when the coil component is mounted on the mounting board, and the inclination of the coil component relative to the mounting board can be suppressed. Additionally, since the stress applied to the terminals can be made uniform, the fixation strength of the coil component to the mounting board 120 can be ensured.

In an embodiment of the coil component, the dummy terminals are disposed between the terminals located at the four corners on at least one pair of opposite sides of the outer shape of the first surface.

According to the embodiment, since the dummy terminals are disposed between the terminals located at the four corners on at least one pair of opposite sides of the outer shape of the first surface, the mounting strength of the coil component to the mounting board is improved.

In an embodiment of the coil component, the first external terminal and the second external terminal are located on the same side of the outer shape of the first surface.

According to the embodiment, since the first external terminal and the second external terminal are located on the same side of the outer shape of the first surface, routing wirings connected to the first and second external terminals 12 can be shortened on the mounting board 120. As a result, the mounting board can be made smaller.

Effect of the Disclosure

According to the coil component of the present disclosure, since the first external terminal and the second external terminal as well as the at least one dummy terminal are disposed on at least one surface on the first surface side of the magnetic resin body, the positional displacement of the coil component can be reduced in the horizontal direction and the rotational direction relative to the mounting board when the coil component is mounted on the mounting board.

DETAILED DESCRIPTION

The present disclosure will now be described in detail with shown embodiments.

Figure 1A:
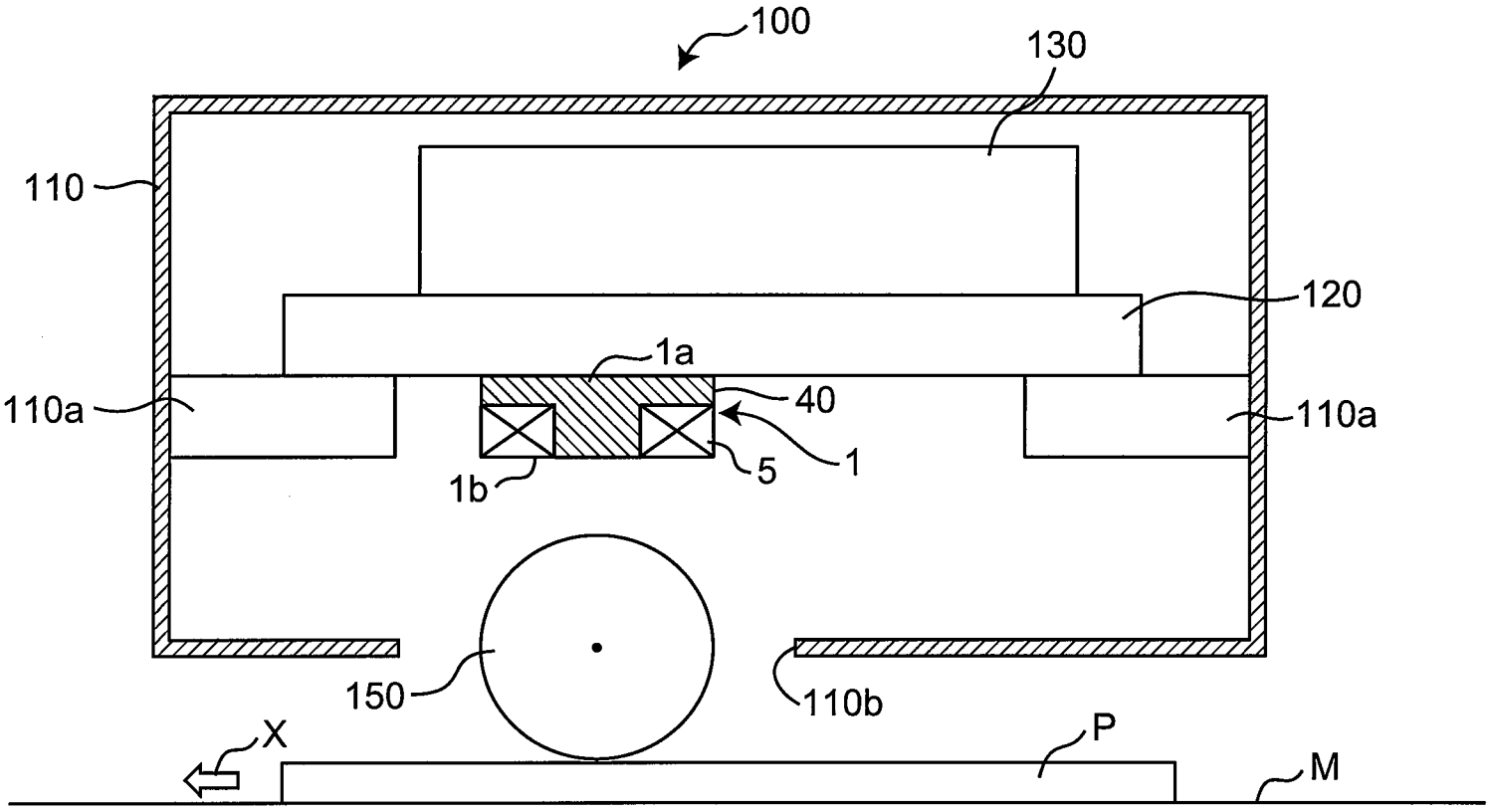
FIG. 1A is a simplified configuration diagram of an embodiment of a thickness detection apparatus including a coil component of the present disclosure.

FIG. 1A is a simplified configuration diagram of a first embodiment of a thickness detection apparatus including a coil component of the present disclosure. As shown in FIG. 1A, a thickness detection apparatus 100 is incorporated into an ATM (automatic teller machine), for example, and detects thickness of paper money. The thickness detection apparatus 100 is disposed above a conveyance path M to detect a thickness of a paper sheet P conveyed in an X direction of the conveyance path M.

The thickness detection apparatus 100 has a casing 110 as well as a mounting board 120, a coil component 1, and a thickness detection circuit 130 disposed in the casing 110, and a roller 150 disposed in an opening part 110*b* on the conveyance path M side of the casing 110.

The mounting board 120 is attached via an attaching part 110*a* to the inside of the casing 110. The coil component 1 is attached to a surface of the mounting board 120 on the conveyance path M side. The thickness detection circuit 130 is attached to a surface of the mounting board 120 on the side opposite to the conveyance path M. The roller 150 is attached to the casing 110 such that the roller 150 freely rotates and freely advances and retracts from the opening part 110*b*. The roller 150 is disposed to face the coil component 1 and freely moves close to and away from the coil component 1.

The roller 150 is rotated while being in contact with the paper sheet P and is displaced in a direction of the coil component 1 depending on the thickness of the paper sheet P. Therefore, the roller 150 detects the thickness of the paper sheet P as a displacement amount. A high frequency signal is applied to the coil component 1 to generate a high-frequency magnetic field. The roller 150 is made of a conductor and generates an eddy current due to the magnetic field generated from the coil component 1.

Figure 1B:
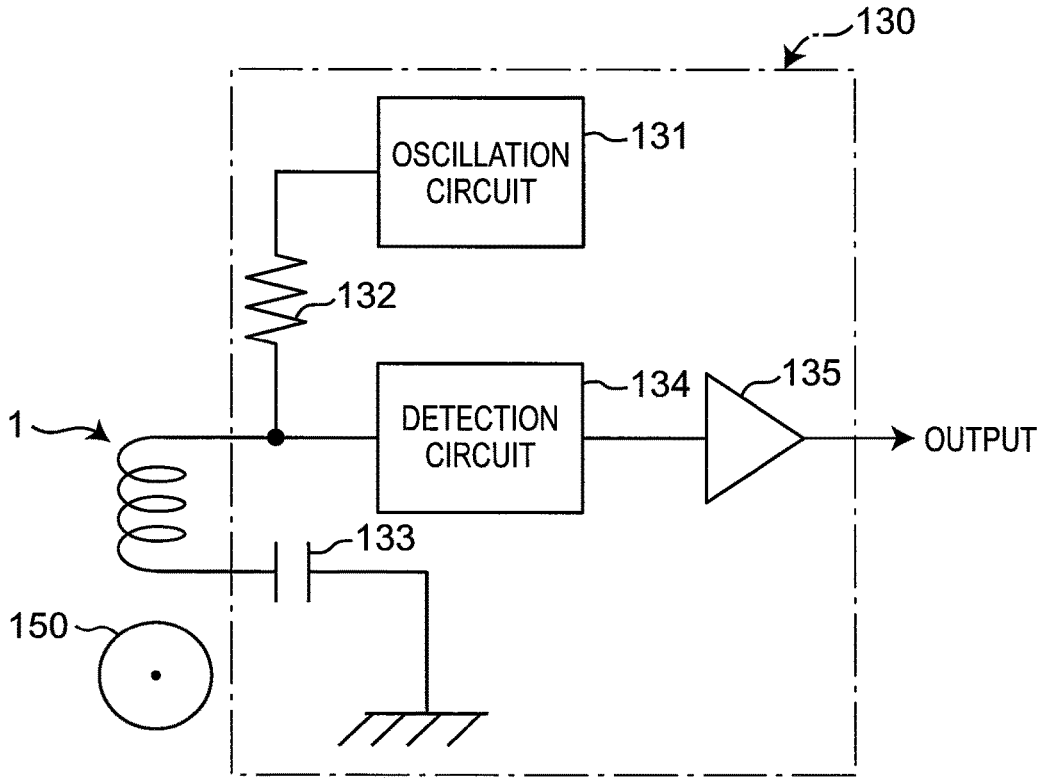
FIG. 1B is a circuit diagram of a thickness detection circuit.

As shown in FIG. 1B, the thickness detection circuit 130 is a circuit electrically detecting the thickness of the paper sheet P and is made up of an oscillation circuit 131, a resistor 132, a capacitor 133, a detection circuit 134, and an amplification circuit 135. The oscillation circuit 131 outputs a high frequency signal through the resistor 132. One end of the coil component 1 (coil conductor) is connected through the resistor 132 to the oscillation circuit 131 and the other end of the coil component 1 (coil conductor) is grounded through the capacitor 133.

The detection circuit 134 is a circuit extracting a direct current signal corresponding to the amplitude of the high frequency signal from the oscillation circuit 131. This direct current signal is a signal proportional to a distance between the roller 150 described later and the coil component 1 (the thickness of the paper sheet P). The amplification circuit 135 amplifies a direct current signal input by the detection circuit 134. An output signal of the amplification circuit 135 corresponds to the thickness of the paper sheet P as a thickness detection result.

An operation of the thickness detection apparatus 100 will be described.

When the oscillation circuit 131 is driven, the oscillation circuit 131 supplies a high frequency signal through the resistor 132 to the coil component 1. As a result, a high-frequency current is applied to the coil component 1 and a high-frequency magnetic field is generated around the coil component 1.

When the paper sheet P is conveyed in the X direction in such a state, the roller 150 is rotated while being in contact with a surface of the paper sheet P, and is displaced in the direction of the coil component 1 depending on a thickness of the paper sheet P.

When the roller 150 is displaced in the direction toward the coil component 1, an eddy-current loss associated with the high-frequency magnetic field from the coil component 1 becomes larger and the amplitude of the high frequency signal from the oscillation circuit 131 therefore becomes smaller.

On the other hand, when the roller 150 is displaced in the direction away from the coil component 1, an eddy-current loss associated with the high-frequency magnetic field from the coil component 1 becomes smaller and the amplitude of the high frequency signal from the oscillation circuit 131 therefore becomes larger.

As described above, the distance between roller 150 and the coil component 1 is proportional to the amplitude of the high frequency signal from the oscillation circuit 131. Therefore, since the distance between the roller 150 and the coil component 1 is proportional to the thickness of the paper sheet P, the amplitude of the high frequency signal from the oscillation circuit 131 is proportional to the thickness of the paper sheet P.

The high frequency signal from the oscillation circuit 131 is detected by the detection circuit 134. Thus, the detection circuit 134 outputs a direct current signal corresponding to the amplitude of the high frequency signal to the amplification circuit 135. As a result, the direct current signal is amplified by the amplification circuit 135. The output signal of the amplification circuit 135 is a signal corresponding to the thickness of the paper sheet P. In this way, the thickness detection apparatus 100 outputs the thickness of the conveyed paper sheet P as the signal from the amplification circuit 135.

Figure 2:
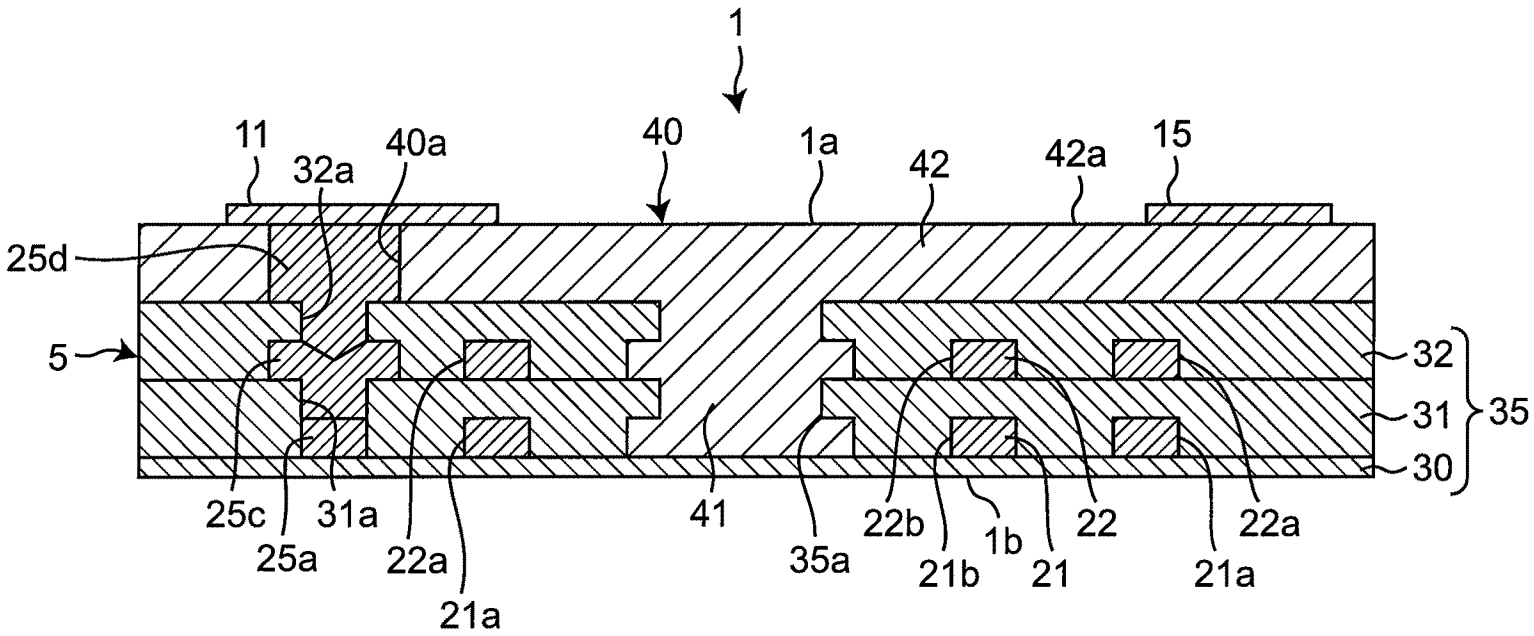
FIG. 2 is a cross-sectional view of an embodiment of the coil component.

FIG. 2 is a cross-sectional view of a first embodiment of the coil component 1. As shown in FIGS. 1A and 2, the coil component 1 includes a first surface 1*a* and a second surface 1*b* facing each other. The first surface 1*a* is a mounting surface that is side mounted on the mounting board 120. The second surface 1*b* is a detecting surface that is a side facing the roller 150 (an example of a detected conductor) and generates a magnetic field toward the roller 150. FIG. 2 is a cross-sectional view taken along a diagonal of the first surface 1*a* in FIG. 4.

The coil component 1 has a coil substrate 5 and a magnetic resin body 40 partially covering the coil substrate 5. The coil substrate 5 has two layers of coil conductors 21, 22 and an insulating resin body 35 covering the two layers of the coil conductors 21, 22.

The first coil conductor 21 and the second coil conductor 22 are arranged in order from a lower layer to an upper layer. The first and second coil conductors 21, 22 are each formed into a planar spiral shape. The first and second coil conductors 21, 22 are made of low-resistance metal such as Cu, Ag, and Au, for example. Preferably, low-resistance and narrow-pitch coil conductors can be formed by using Cu plating formed by a semi-additive process.

Figure 3A:
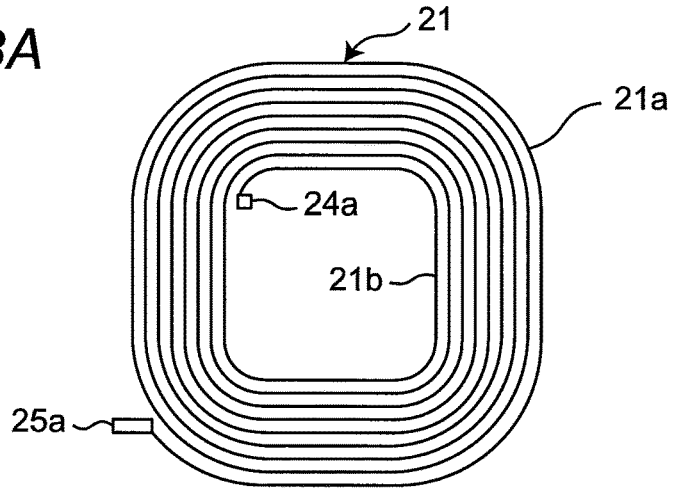
FIG. 3A is a plane view of a first coil conductor.
Figure 3B:
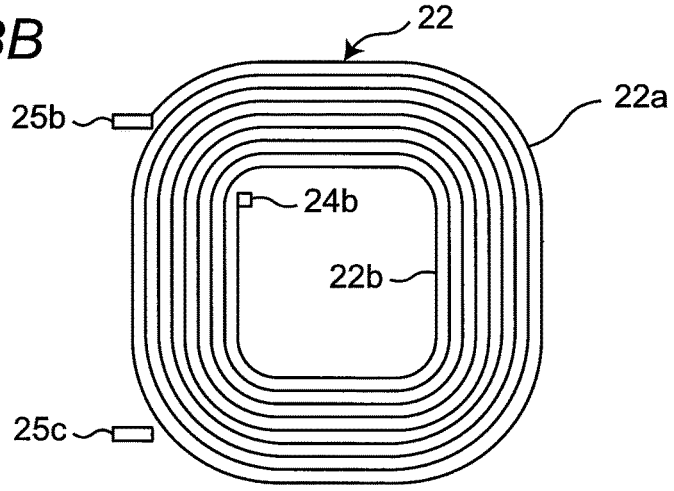
FIG. 3B is a plane view of a second coil conductor.

As shown in FIG. 3A, the first coil conductor 21 has a planar spiral shape counterclockwise from the outer circumference toward the inner circumference. As shown in FIG. 3B, the second coil conductor 22 has a planar spiral shape counterclockwise from the inner circumference toward the outer circumference. In FIG. 2, the number of turns of the coil conductors 21, 22 are reduced as compared to FIGS. 3A and 3B for easy understanding.

Figure 3C:
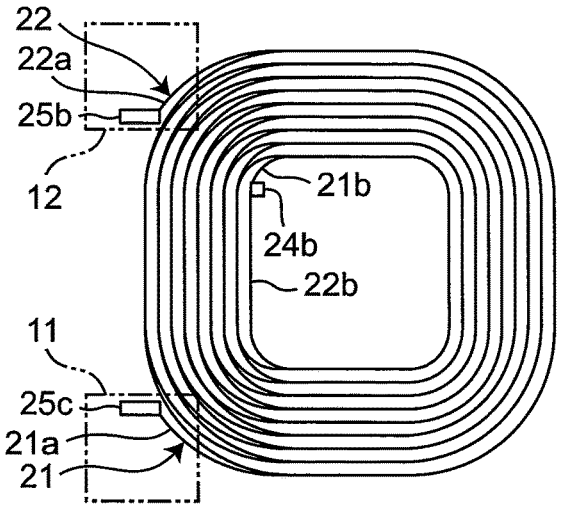
FIG. 3C is a plane view of the first coil conductor and the second coil conductor.

An inner circumferential end of the first coil conductor 21 is connected to an inner circumferential connection wiring 24*a*. An inner circumferential end of the second coil conductor 22 is connected to the inner circumferential connection wiring 24*b*. As shown in FIG. 3C, the respective inner circumferential connection wirings 24*a*, 24*b* are electrically connected through connection via (not shown) to each other.

An outer circumferential end of the first coil conductor 21 is connected to an outer circumferential connection wiring 25*a*. An outer circumferential end of the second coil conductor 22 is connected to an outer circumferential connection wiring 25*b*. The outer circumferential connection wiring 25*a* connected to the outer circumferential end of the first coil conductor 21 is connected to a first external terminal 11 through an outer circumferential connection wiring 25*c* (FIG. 3B) disposed on the same layer as the second coil conductor 22 without connection to the second coil conductor 22 and an outer circumferential connection wiring 25*d* on an upper layer above this outer circumferential connection wiring 25*c*. Similarly, the outer circumferential connection wiring 25*b* connected to the outer circumferential end of the second coil conductor 22 is connected to a second external terminal 12 through an outer circumferential connection wiring (not shown) on an upper layer above the outer circumferential connection wiring 25*b*.

The central axes of the first and second coil conductors 21, 22 are concentrically arranged to intersect with the first surface 1*a* and the second surface 1*b*. In this embodiment, the central axes of the first and second coil conductors 21, 22 are orthogonal to the first surface 1*a* and the second surface 1*b*.

The insulating resin body 35 has a base insulating resin 30, a first insulating resin 31, and a second insulating resin 32. The base insulating resin 30 and the first and second insulating resins 31, 32 are arranged in order from a lower layer to an upper layer. The material of the insulating resins 30 to 32 is, for example, a single material that is an organic insulating material made of epoxy-based resin, bismaleimide, liquid crystal polymer, polyimide, etc., or is an insulating material comprising a combination of these organic insulating materials and an inorganic filler material such as a silica filler or an organic filler made of a rubber material. Preferably, all the insulating resins 30 to 32 are made of the same material. In this embodiment, all the insulating resins 30 to 32 are made of an epoxy resin containing a silica filler.

The first coil conductor 21 is laminated on the base insulating resin 30. The first insulating resin 31 is laminated on the first coil conductor 21 to cover the first coil conductor 21. The second coil conductor 22 is laminated on the first insulating resin 31. The second insulating resin 32 is laminated on the second coil conductor 22 to cover the second coil conductor 22. The second coil conductor 22 is connected to the first coil conductor 21 through a via hole (not shown) disposed in the first insulating resin 31.

Outer surfaces 21*a*, 22*a* and inner surfaces 21*b*, 22*b* of the first and second coil conductors 21, 22 are covered with the insulating resin body 35. The insulating resin body 35 has an inner diameter hole part 35*a* corresponding to the central axes of the first and second coil conductors 21, 22. The inner diameter hole part 35*a* is made up of hole parts of the first and second insulating resins 31, 32.

The outer surfaces 21*a*, 22*a* refer to only the outer side surfaces of outermost circumferences of spirals. Therefore, the outer surfaces 21*a*, 22*a* do not include upper surfaces, lower surfaces, and outer side surfaces of inner circumferential turn parts. Additionally, the outer surfaces 21*a*, 22*a* do not include the outer surfaces of the outer circumferential connection wirings 25*a* to 25*d* that are not the coil conductors.

The inner surfaces 21*b*, 22*b* refer to only the inner side surfaces of innermost circumferences of spirals. Therefore, the inner surfaces 21*b*, 22*b* do not include upper surfaces, lower surfaces, and inner side surfaces of inner circumferential turn parts. Additionally, the inner surfaces 21*b*, 22*b* do not include the inner surfaces of the inner circumferential connection wirings 24*a*, 24*b* that are not the coil conductors.

The magnetic resin body 40 is disposed on the first surface 1*a* side of the first and second coil conductors 21, 22 without being disposed on the second surface 1*b* side of the first and second coil conductors 21, 22. The magnetic resin body 40 is disposed on the inside (in the inner diameter hole part 35*a*) of the inner surfaces 21*b*, 22*b* of the first and second coil conductors 21, 22.

Therefore, the magnetic resin body 40 has an inner portion 41 disposed in the inner diameter hole part 35*a* of the insulating resin body 35 and an end portion 42 disposed on an end surface on the first surface 1*a* side of the insulating resin body 35. The inner portion 41 makes up an inner magnetic path of the coil component 1 and the end portion 42 makes up an outer magnetic path of the coil component 1. The end portion 42 entirely covers the first surface 1*a* side of the insulating resin body 35. In particular, the magnetic resin body 40 is disposed on the entire surface on the first surface 1*a* side of the first and second coil conductors 21, 22. The end portion 42 covers the first and second coil conductors 21, 22 when viewed from the first surface 1*a* side in the axial direction of the first and second coil conductors 21, 22, and is disposed from the outer side of the outer surfaces 21*a*, 22*a* of the first and second coil conductors 21, 22 onto the inner portion 41.

The material of the magnetic resin body 40 is, for example, a resin material containing magnetic powder. The magnetic powder is, for example, a metal magnetic material such as Fe, Si, and Cr and the resin material is, for example, a resin material such as epoxy. For improvement of the characteristics of the coil component 1 (L-value and superposition characteristics), it is desirable to contain the magnetic powder at 90 wt % or more and, for improvement of a filling property of the magnetic resin body 40, it is more desirable to mix two or three types of magnetic powder different in particle size distribution.

The insulating resin body 35 has a lower magnetic permeability and a higher thermal expansion coefficient than the magnetic resin body 40. The thermal expansion coefficient of the first and second coil conductors 21, 22 is larger than the thermal expansion coefficient of the magnetic resin body 40 and smaller than the thermal expansion coefficient of the insulating resin body 35. For example, in the case of typical materials listed above, the thermal expansion coefficient of the insulating resin body 35 is 30 to 50 ppm/K; the thermal expansion coefficient of the magnetic resin body 40 is 0 to 15 ppm/K; and the thermal expansion coefficient of the first and second coil conductors 21, 22 is 16 ppm/K. Therefore, usual materials can be used for the first and second coil conductors 21, 22, the insulating resin body 35, and the magnetic resin body 40.

Figure 4:
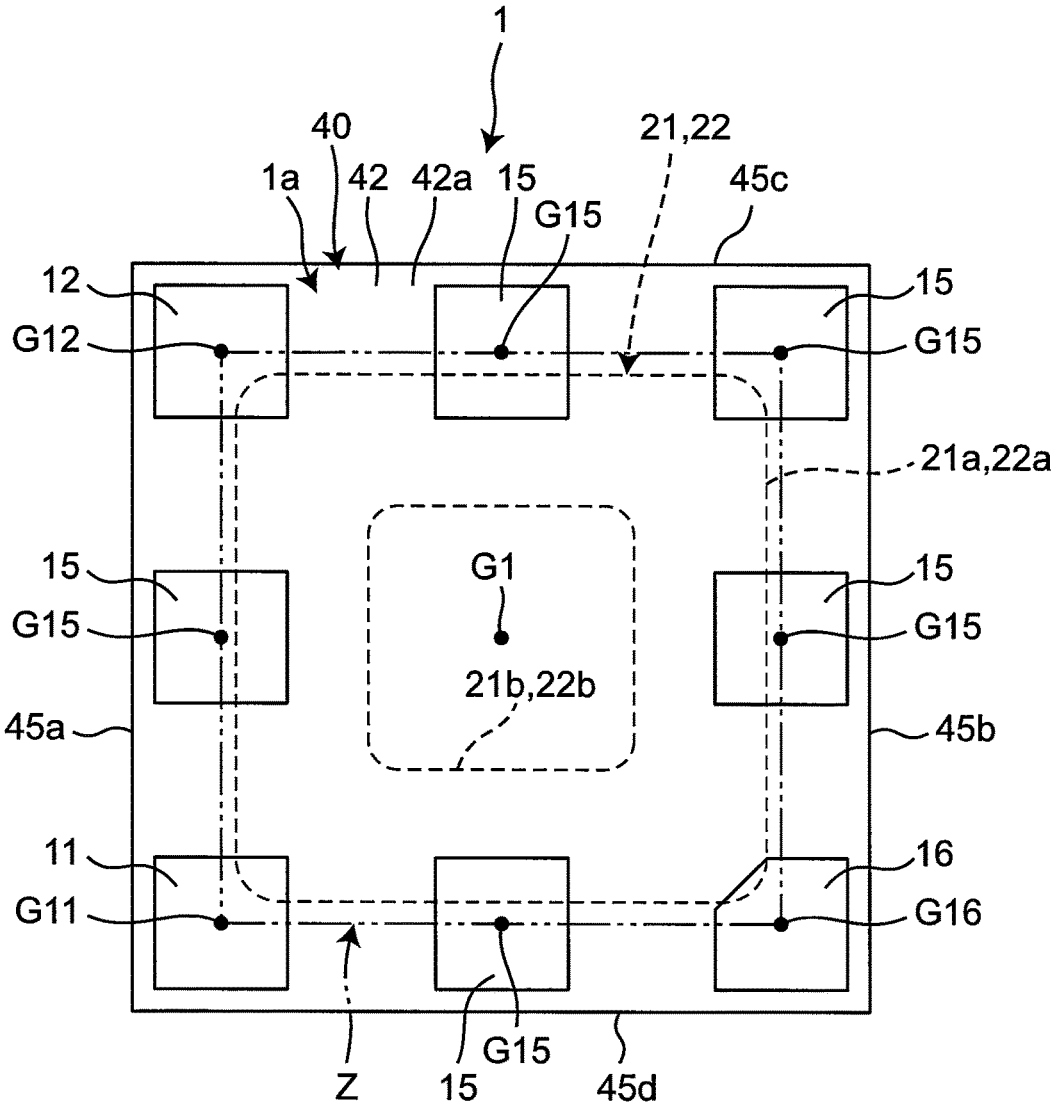
FIG. 4 is a simplified plane view of the coil component.

FIG. 4 is a simplified plane view of the coil component 1. As shown in FIG. 4, the first external terminal 11, the second external terminal 12, and a plurality of (in this embodiment, six) dummy terminals 15, 16 are disposed on one surface 42*a* on the first surface 1*a* side of the magnetic resin body 40 (the end portion 42). As described above, the first external terminal 11 and the second external terminal 12 are electrically connected to the first and second coil conductors 21, 22. All the dummy terminals 15, 16 are not electrically connected to the first and second coil conductors 21, 22.

The first and second external terminals 11, 12 and the dummy terminals 15, 16 are made of a mixed material of resin and metal. The metal is made of, for example, Ag, Cu, and Au having small resistivity. The resin is made of, for example, phenol resin having a small Young's modulus. Surfaces of the terminals 11, 12, 15, 16 may be coated with Ni/Sn plating etc., so as to ensure wettability with solder. The terminals 11, 12, 15, 16 are bottom terminals disposed on only the one surface 42*a* of the magnetic resin body 40.

When viewed in a direction orthogonal to the first surface 1*a*, the first external terminal 11, the second external terminal 12, and the five dummy terminals 15 (hereinafter referred to as the same-shaped dummy terminals 15) have the same shape as each other and are quadrangular. The shape of the one dummy terminal 16 (hereinafter referred to as the different-shaped dummy terminal 16) is different from the shape of the other terminals 11, 12, 15 and is a pentagon. The respective areas of the first external terminal 11, the second external terminal 12, and all the dummy terminals 15, 16 are the same as each other.

When viewed in the direction orthogonal to the first surface 1*a*, the shape of the outer circumference side of the magnetic resin body 40 is a quadrangle. The outer shape of the magnetic resin body 40 has four sides 45*a* to 45*d*. The first side 45*a* and the second side 45*b* are opposite to each other while the third side 45*c* and the fourth side 45*d* are opposite to each other.

The first external terminal 11, the second external terminal 12, one of the same-shaped dummy terminals 15, and the one different-shaped dummy terminal 16 are respectively located at the four corners of the magnetic resin body 40. The first external terminal 11 and the second external terminal 12 are located at the same first side 45*a* of the outer shape of the magnetic resin body 40. In particular, the first external terminal 11 is located at the corner between the first side 45*a* and the fourth side 45*d*; the second external terminal 12 is located at the corner between the first side 45*a* and the third side 45*c*; the one same-shaped dummy terminal 15 is located at the corner between the second side 45*b* and the third side 45*c*; and the one different-shaped dummy terminal 16 is located at the corner between the second side 45*b* and the fourth side 45*d*.

On the two pairs of the opposite sides 45*a* to 45*d* of the outer shape of the magnetic resin body 40, the same-shaped dummy terminals 15 are disposed between the terminals 11, 12, 15, 16 located at the four corners. In particular, with regard to the first and second sides 45*a*, 45*b* that are the opposite sides, the first side 45*a* has the same-shaped dummy terminal 15 disposed between the first external terminal 11 and the second external terminal 12 located at the corners, and the second side 45*b* has the same-shaped dummy terminal 15 disposed between the same-shaped dummy terminal 15 and the different-shaped dummy terminal 16 located at the corners. With regard to the third and fourth sides 45*c*, 45*d* that are the opposite sides, the third side 45*c* has the same-shaped dummy terminal 15 disposed between the second external terminal 12 and the same-shaped dummy terminal 15 located at the corners, and the fourth side 45*d* has the same-shaped dummy terminal 15 disposed between the first external terminal 11 and the different-shaped dummy terminal 16 located at the corners.

When viewed in the direction orthogonal to the first surface 1*a*, a gravity center G1 of the one surface 42*a* of the magnetic resin body 40 (i.e., the first surface 1*a*) is included in a region Z formed by connecting a gravity center G11 of the first external terminal 11, a gravity center G12 of the second external terminal 12, gravity centers G15 of the five same-shaped dummy terminals 15, and a gravity center G16 of the different-shaped dummy terminal 16. This region Z is formed into a substantially quadrangular shape. In the above description, the "gravity centers" are the centroids of the plane figures represented by the one surface 42*a* (the first surface 1*a*), the first external terminal 11, the second external terminal 12, and the dummy terminals 15,16 viewed in the direction orthogonal to the first surface 1*a* and can be determined by a known method. For example, when a surface is polygonal, the polygon may be divided into triangles by drawing one or more diagonals from a certain vertex and a vector may be obtained as a weighted average of the vectors of the gravity centers of the triangles by using the areas of the triangles. Particularly, when a surface is rectangular, the intersection of the diagonals is the gravity center. For example, when a surface is circular, the center of the circle is the gravity center. When a surface has a substantially polygon shape or a substantially circular shape, the gravity center may be obtained from a polygon or a circle approximated to the surface.

When viewed in the direction orthogonal to the first surface 1*a*, the first external terminal 11, the second external terminal 12, and all the dummy terminals 15, 16 are located outside the inner surfaces 21*b*, 22*b* of the first and second coil conductors 21, 22. FIG. 4 schematically shows the innermost surface of the first and second coil conductors 21, 22 (the inner surface 21*b* or the inner surface 22*b* located on the inner side). Actually, the innermost surface may not have a substantially quadrangular shape as shown in FIG. 4 due to the positions of the inner circumferential connection wirings 24*a*, 24*b* and the discontinuity between the first and second coil conductors 21, 22.

When viewed in the direction orthogonal to the first surface 1*a*, the first external terminal 11, the second external terminal 12, and all the dummy terminals 15, 16 have the sum of areas of portions overlapping with the outside of the outer surfaces 21*a*, 22*a* of the first and second coil conductors 21, 22 larger than the sum of areas overlapping with the inside of the outer surfaces 21*a*, 22*a* of the first and second coil conductors 21, 22. FIG. 4 schematically shows the outermost surface of the first and second coil conductors 21, 22 (the outer surface 21*a* or the outer surface 22*a* located on the outer side). Actually, the outermost surface may not have a substantially quadrangular shape as shown in FIG. 4 due to the positions of the outer circumferential connection wirings 25*a* to 25*d* and the discontinuity between the first and second coil conductors 21, 22.

When viewed in the direction orthogonal to the first surface 1*a*, the respective shapes of the first external terminal 11, the second external terminal 12, and all the dummy terminals 15, 16 on the outer circumferential side of the magnetic resin body 40 are the same as each other. The shapes of the terminals 11, 12, 15, 16 on the outer circumferential side of the magnetic resin body 40 refer to the shapes of the terminals 11, 12, 15, 16 in the portions facing the outer shape of the magnetic resin body 40. Specifically, the shapes of the terminals 11, 12, 15, 16 on the outer circumferential side of the magnetic resin body 40 are the shapes along the outer shape of the end portion 42 of the magnetic resin body 40 and are made up of two straight lines perpendicular to each other. Among the terminals 11, 12, 15, 16, the lengths corresponding to the two straight lines are equal and these shapes on the outer circumferential side are the same. It is noted that being "the same as each other" may not be strict and may mean being substantially the same. For example, even when a difference exists to the extent of tolerance relative to a design value, the shapes are considered as being "the same as each other."

A manufacturing method of the coil component 1 will be described with reference to FIGS. 5A to 5O. Cross sections of FIGS. 5A to 5O correspond to the cross section of FIG. 2.

Figure 5A:
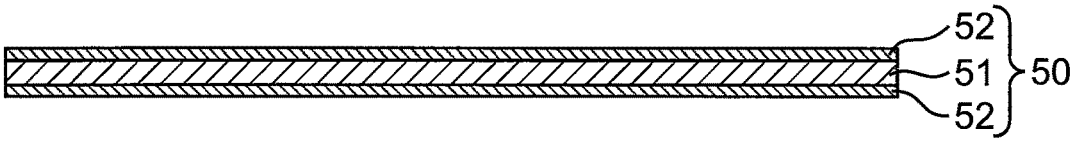
FIG. 5A is an explanatory view for explaining an embodiment of a manufacturing method of the coil component of the present disclosure.

As shown in FIG. 5A, a base 50 is prepared. The base 50 has an insulating substrate 51 and base metal layers 52 disposed on the both sides of the insulating substrate 51. In this embodiment, the insulating substrate 51 is a glass epoxy substrate and the base metal layers 52 are Cu foils.

Figure 5B:
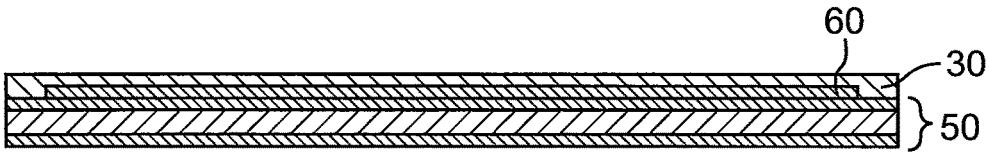
FIG. 5B is an explanatory view for explaining the embodiment of the manufacturing method of the coil component of the present disclosure.

As shown in FIG. 5B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to a smooth surface of the base metal layer 52. Therefore, an adhesion force can be made weak between the dummy metal layer 60 and the base metal layer 52 and, at a subsequent step, the base 50 can easily be peeled from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the base insulating resin 30 is laminated on the dummy metal layer 60 temporarily bonded to the base 50. In this case, the base insulating resin 30 is laminated by a vacuum laminator and is then thermally cured.

Figure 5C:
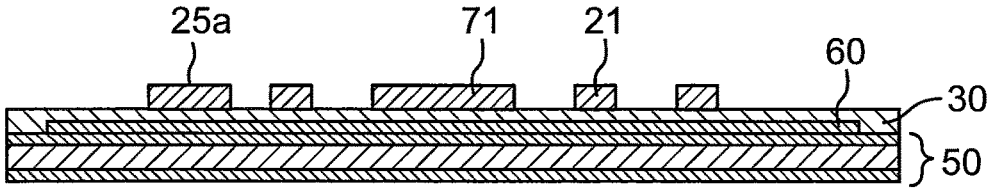
FIG. 5C is an explanatory view for explaining the embodiment of the manufacturing method of the coil component of the present disclosure.

As shown in FIG. 5C, the first coil conductor 21, a first sacrificial conductor 71 corresponding to the inner magnetic path, and the outer circumferential connection wiring 25*a* are disposed on the base insulating resin 30. In this case, the first coil conductor 21, the first sacrificial conductor 71, and the outer circumferential connection wiring 25*a* are formed at the same time by the semi-additive process. The inner circumferential connection wirings 24*a*, 24*b* (see FIGS. 3A and 3B) are formed in the same way as the outer circumferential connection wiring 25*a*.

Figure 5D:
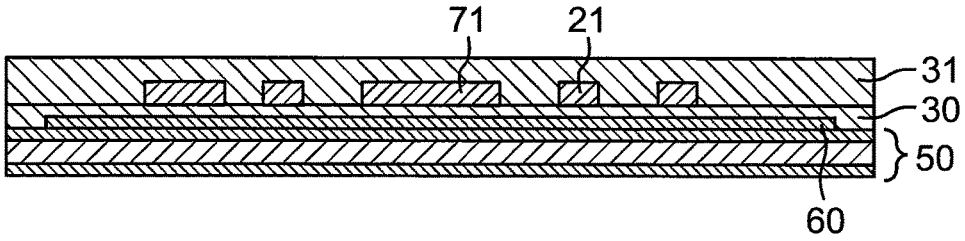
FIG. 5D is an explanatory view for explaining the embodiment of the manufacturing method of the coil component of the present disclosure.

As shown in FIG. 5D, the first coil conductor 21 and the first sacrificial conductor 71 are covered with the first insulating resin 31. In this case, the first insulating resin 31 is laminated by a vacuum laminator and is then thermally cured.

Figure 5E:
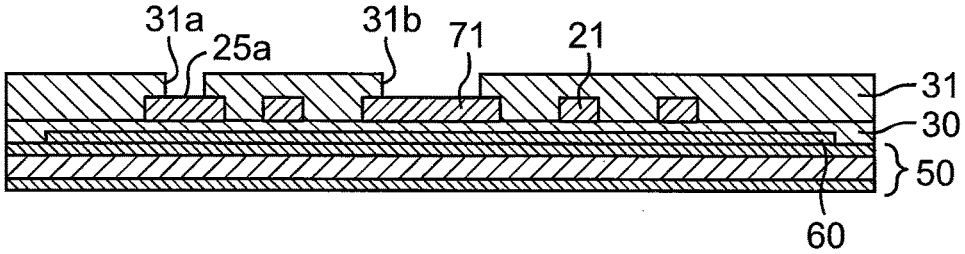
FIG. 5E is an explanatory view for explaining the embodiment of the manufacturing method of the coil component of the present disclosure.

As shown in FIG. 5E, the via hole 31*a* is disposed in a portion of the first insulating resin 31 to expose the outer circumferential connection wiring 25*a*, and an opening part 31*b* is disposed in a portion of the first insulating resin 31 to expose the first sacrificial conductor 71. The via hole 31*a* and the opening part 31*b* are formed by laser machining.

Figure 5F:
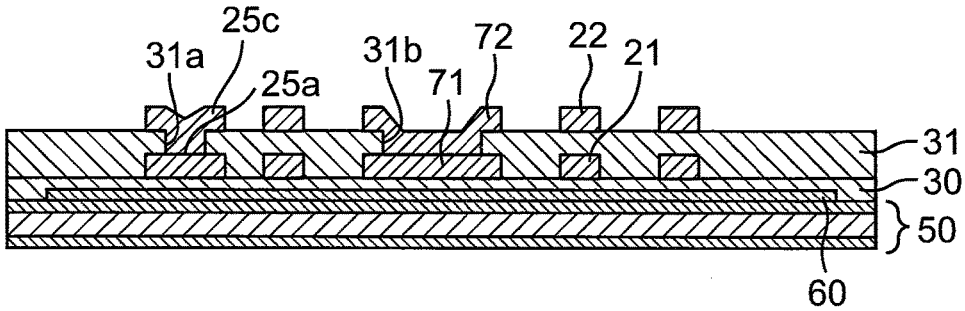
FIG. 5F is an explanatory view for explaining the embodiment of the manufacturing method of the coil component of the present disclosure.

As shown in FIG. 5F, the second coil conductor 22 is disposed on the first insulating resin 31. The outer circumferential connection wiring 25*c* is disposed in the via hole 31*a* of the first insulating resin 31 and is connected to the outer circumferential connection wiring 25*a* on the same layer as the first coil conductor 21. A second sacrificial conductor 72 corresponding to the inner magnetic path is disposed on the first sacrificial conductor 71 in the opening part 31*b* of the first insulating resin 31.

Figure 5G:
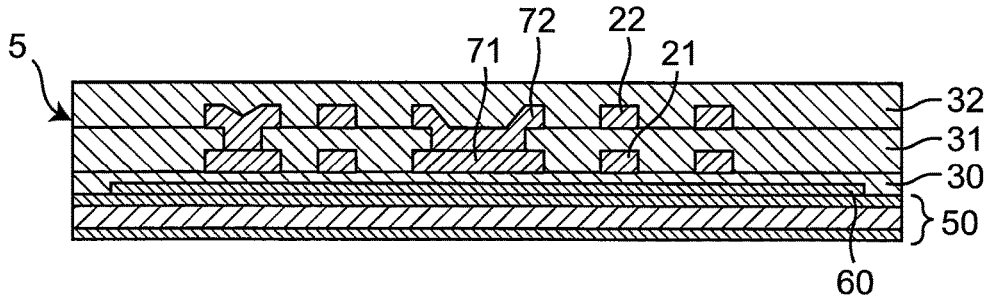
FIG. 5G is an explanatory view for explaining the embodiment of the manufacturing method of the coil component of the present disclosure.

As shown in FIG. 5G, the second coil conductor 22 and the second sacrificial conductor 72 are covered with the second insulating resin 32. In this way, the coil substrate 5 is formed of the coil conductors 21, 22 and the insulating resins 30 to 32.

Figure 5H:
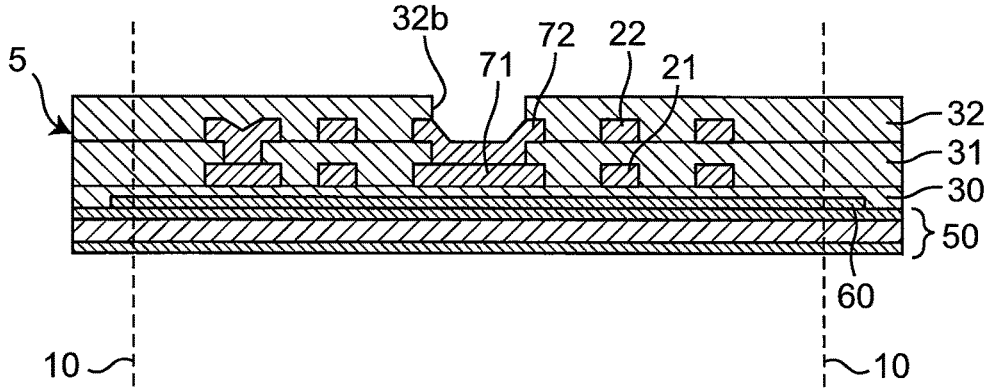
FIG. 5H is an explanatory view for explaining the embodiment of the manufacturing method of the coil component of the present disclosure.

As shown in FIG. 5H, an opening part 32*b* is disposed in a portion of the second insulating resin 32 to expose the second sacrificial conductor 72. An end part of the coil substrate 5 is cut off along a cutline 10 together with an end part of the base 50. The cutline 10 is located on the inner side from an end surface of the dummy metal layer 60.

Figure 5I:
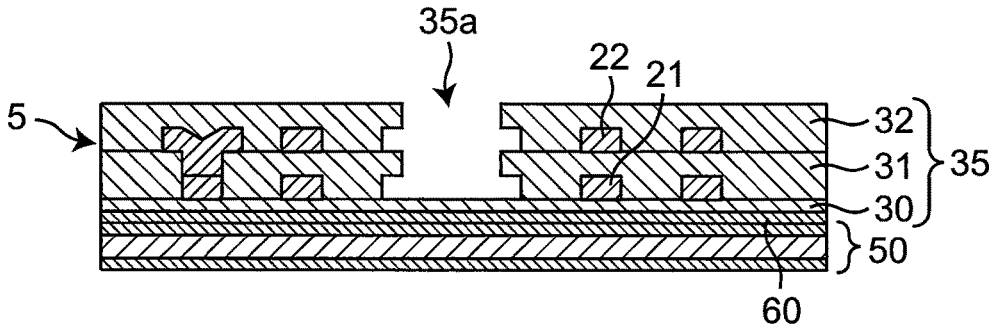
FIG. 5I is an explanatory view for explaining the embodiment of the manufacturing method of the coil component of the present disclosure.

As shown in FIG. 5I, the first and second sacrificial conductors 71, 72 are removed and the inner diameter hole part 35*a* corresponding to the inner magnetic path is disposed in the insulating resin body 35 made up of the insulating resins 30 to 32. The first and second sacrificial conductors 71, 72 are removed by etching. The materials of the sacrificial conductors 71, 72 are, for example, the same material as the coil conductors 21, 22.

Figure 5J:
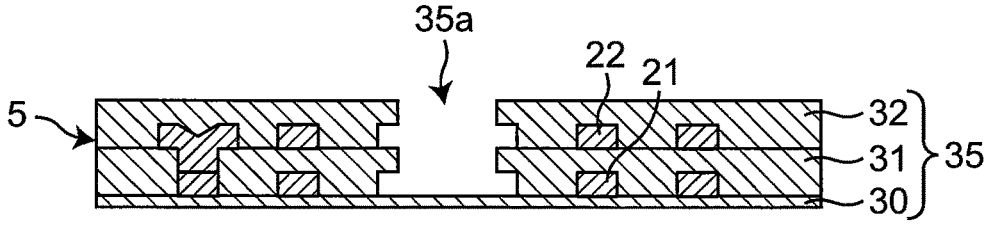
FIG. 5J is an explanatory view for explaining the embodiment of the manufacturing method of the coil component of the present disclosure.

As shown in FIG. 5J, the base 50 is peeled off from the dummy metal layer 60 on the bonding plane between the surface of the base 50 (the base metal layer 52) and the dummy metal layer 60 and the dummy metal layer 60 is removed by etching.

Figure 5K:
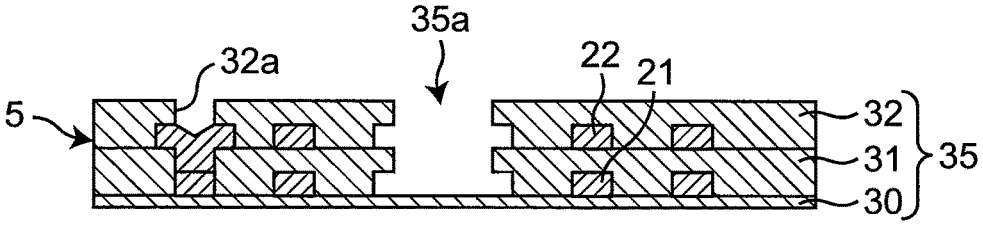
FIG. 5K is an explanatory view for explaining the embodiment of the manufacturing method of the coil component of the present disclosure.

As shown in FIG. 5K, the via hole 32*a* is disposed in a portion of the second insulating resin 32 to expose the outer circumferential connection wiring 25*c* on the same layer as the second coil conductor 22.

Figure 5L:
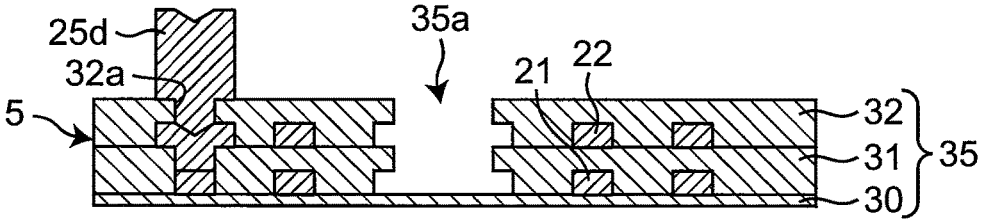
FIG. 5L is an explanatory view for explaining the embodiment of the manufacturing method of the coil component of the present disclosure.

As shown in FIG. 5L, the outer circumferential connection wiring 25*d* is disposed in the via hole 32*a* of the second insulating resin 32 to connect the outer circumferential connection wiring 25*d* to the outer circumferential connection wiring 25*c* on the same layer as the second coil conductor 22. The outer circumferential connection wiring 25*d* is formed by the semi-additive process.

Figure 5M:
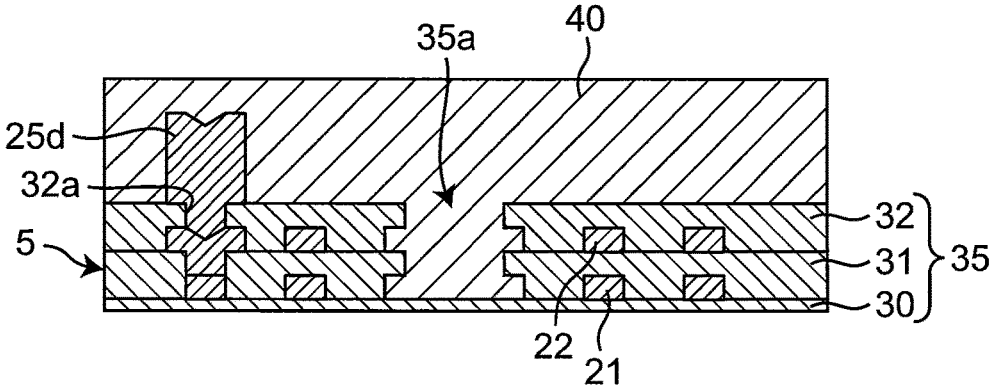
FIG. 5M is an explanatory view for explaining the embodiment of the manufacturing method of the coil component of the present disclosure.

As shown in FIG. 5M, one surface of the coil substrate on the second insulating resin 32 side is covered with the magnetic resin body 40. In this case, a plurality of sheets of the shaped magnetic resin body 40 is disposed on one side of the coil substrate 5 in the lamination direction, is heated and press-bonded by a vacuum laminator or a vacuum press machine, and is subsequently subjected to cure treatment. The magnetic resin body 40 is filled into the inner diameter hole part 35*a* of the insulating resin body 35 to make up the inner magnetic path and is disposed on one surface of the insulating resin body 35 to make up the outer magnetic path.

Figure 5N:
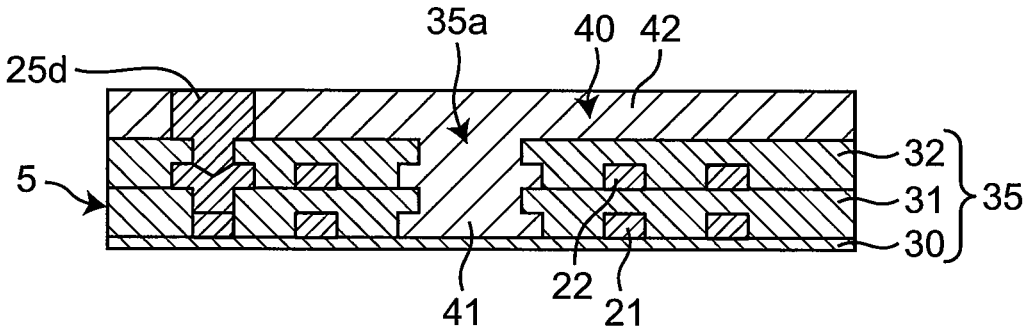
FIG. 5N is an explanatory view for explaining the embodiment of the manufacturing method of the coil component of the present disclosure.

As shown in FIG. 5N, the magnetic resin body 40 is subjected to grinding by a back grinder etc. to adjust chip thickness. In this case, an upper part of the outer circumferential connection wiring 25*d* is exposed.

Figure 5O:
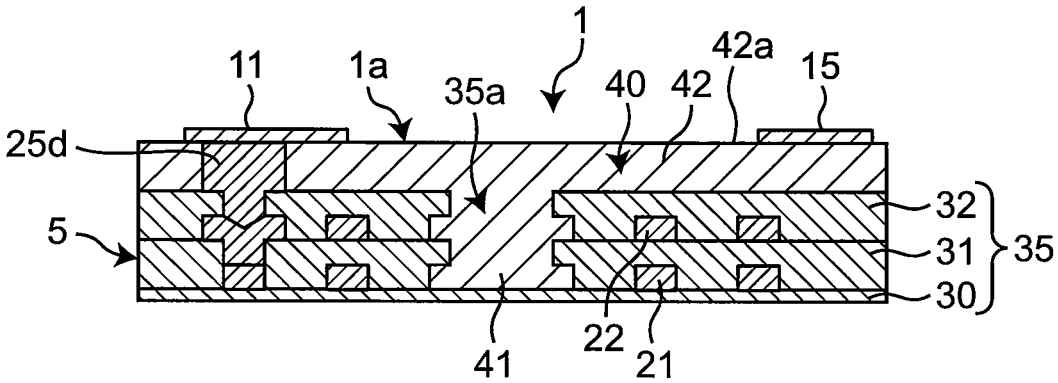
FIG. 5O is an explanatory view for explaining the embodiment of the manufacturing method of the coil component of the present disclosure.

As shown in FIG. 5O, on the one surface 42*a* of the magnetic resin body 40, the first external terminal 11 is disposed and connected to the outer circumferential connection wiring 25*d* and the dummy terminals 15 are disposed without electric connection to the coil conductors 21, 22. The external terminal 11 and the dummy terminals 15 are formed by application of resin electrodes with dispersed metal microparticles by screen printing followed by dry-curing. Ni/Sn plating coating films are formed on the external terminal 11 and the dummy terminals 15 and, subsequently, a dicer etc. are used for cutting into individual chips so as to acquire the coil component 1. The external terminal 11 and the dummy terminals 15 may be formed by sputtering or plating instead of screen printing. In this case, the external terminal 11 and the dummy terminals 15 are not limited to a mixed material of resin and metal and may be made of a metal material. The second external terminal 12 and the different-shaped dummy terminal 16 are formed in the same manner.

According to the coil component 1, the first and second external terminals 11, 12 and the dummy terminals 15, 16 are disposed on the one surface 42*a* on the first surface 1*a* side of the magnetic resin body 40. As a result, when the first surface 1*a* of the coil component 1 is mounted on the mounting board 120, the coil component 1 can stably be supported at four points by disposing the first and second external terminals 11, 12 and the dummy terminals 15, 16 on the mounting board 120. Therefore, when the coil component 1 is mounted on the mounting board 120 by solder etc., a positional displacement of the coil component 1 can be reduced in the horizontal direction and the rotational direction relative to the mounting board 120. As a result, when the coil component 1 is used for the thickness detection apparatus 100, a variation in distance to the roller 150 can be reduced so as to decrease a variation in detection sensitivity to the thickness of the paper sheet P. Therefore, erroneous detection can be reduced in the thickness detection apparatus 100 in which the coil component 1 is used.

The first and second external terminals 11, 12 and the dummy terminals 15, 16 may be disposed on at least the one surface 42*a* of the magnetic resin body 40. In particular, the terminals 11, 12, 15, 16 may not be the bottom terminals and may be L-shaped terminals disposed on one surface (bottom surface) and side surfaces of the magnetic resin body 40.

At least one dummy terminal may be included. In this case, the coil component 1 can be stably supported at at least three points by the first and second external terminals 11, 12 and the at least one dummy terminal. When one dummy terminal is included, the region formed by connecting the respective gravity centers of the first external terminal 11, the second external terminal 12, and the dummy terminal may be a triangle or, when a plurality of dummy terminals is included, the region formed by connecting the respective gravity centers of the first external terminal 11, the second external terminal 12, and the dummy terminals may be polygonal or circular.

According to the coil component 1, since the magnetic resin body 40 is disposed on the entire surface on the first surface 1*a* side of the first and second coil conductors 21, 22, the magnetic resin body 40 can suppress a magnetic flux leakage from the first surface 1*a* of the coil component 1. The magnetic resin body 40 may at least partially cover the first surface 1*a* side of the coil conductors 21, 22.

According to the coil component 1, since the first surface 1*a* is the mounting surface, the magnetic resin body 40 is disposed on the mounting surface 1*a* side of the coil conductors 21, 22. As a result, the magnetic resin body 40 can suppress a magnetic flux leakage from the mounting surface of the coil component 1. Therefore, when the mounting surface of the coil component 1 is mounted on the mounting board 120, the magnetic flux leakage to the mounting board 120 side of the coil component 1 can be suppressed to acquire a desired inductance. Additionally, by suppressing the magnetic flux leakage to the mounting board 120 side of the coil component 1, the magnetic coupling to a wiring and another electronic component disposed on the mounting board 120 can be suppressed to acquire a desired resonance operation. As a result, a wiring and an electronic component can be arranged in the vicinity of the coil component 1 so as to achieve a reduction in size of the mounting board 120 on which the coil component 1 is mounted. Therefore, the thickness detection apparatus 100 can be reduced in size as a system including the coil component 1.

On the other hand, since the second surface 1*b* is the detecting surface, the magnetic resin body 40 is not disposed on the detecting surface 1*b* side of the coil conductors 21, 22. As a result, the magnetic resin body 40 does not interfere with the generation of the magnetic field from the detecting surface of the coil component 1. Therefore, when the detecting surface of the coil component 1 is allowed to face the roller 150 acting as the detected conductor, the magnetic resin body 40 does not interfere with the generation of the magnetic field to the roller 150 side of the coil component 1 and does not reduce the sensitivity of the detection of the roller 150 by using the coil component 1.

According to the coil component 1, since the gravity center G1 of the one surface 42*a* of the magnetic resin body 40 (the first surface 1*a*) is included in the region Z formed by connecting the respective gravity centers G11, G12, G15, G16 of the first external terminal 11, the second external terminal 12, and all the dummy terminals 15, 16, the coil component 1 can be disposed on the mounting board 120 in a more stable posture. Therefore, the positional displacement of the coil component 1 can further be reduced in the horizontal direction and the rotational direction relative to the mounting board 120.

Preferably, when the gravity center G1 of the one surface 42*a* of the magnetic resin body 40 (the first surface 1*a*) is included in the inscribed circle of the region Z, the coil component 1 can be disposed in a more stable posture.

According to the coil component 1, since the first external terminal 11, the second external terminal 12, and all the dummy terminals 15, 16 are located outside the inner surfaces 21*b*, 22*b* of the coil conductors 21, 22, the first external terminal 11, the second external terminal 12, and all the dummy terminals 15, do not overlap with the inner magnetic path of the coil conductors 21, 22. Therefore, since the magnetic flux generated in the inner magnetic path is not blocked by the dummy terminals 15, 16, the efficiency of acquisition of the L-value of the coil component 1 can be restrained from decreasing.

According to the coil component 1, since the first external terminal 11, the second external terminal 12, and all the dummy terminals 15, 16 have the sum of areas of portions overlapping with the outside of the outer surfaces 21*a*, 22*a* of the coil conductors 21, 22 larger than the sum of areas overlapping with the inside of the outer surfaces 21*a*, 22*a* of the coil conductors 21, 22, a stray capacitance can be reduced in a portion from the first external terminal 11, the second external terminal 12, and all the dummy terminals 15, 16 to the coil conductors 21, 22. Additionally, SRF (Self-Resonant Frequency) can be made higher.

According to the coil component 1, since the respective areas of the first external terminal 11, the second external terminal 12, and all the dummy terminals 15,16 are the same as each other, an amount of solder attached at the time of mounting is made equal between the terminals so that the stress applied to the terminals can be made uniform when the coil component 1 is mounted on the mounting board 120, and an inclination of the coil component 1 relative to the mounting board 120 can be suppressed.

According to the coil component 1, since the shape of the different-shaped dummy terminal 16 is different from the first external terminal 11, the second external terminal 12, and the same-shaped dummy terminals 15, the different-shaped dummy terminal 16 can be used as a directional marker and the directionality of the coil component 1 can be recognized. Therefore, when the coil component 1 is mounted onto the mounting board 120, the first external terminal 11 and the second external terminal 12 can easily be connected to respective corresponding signal lines. For example, when the arrangement of the external terminals and the dummy terminals on the one surface 42*a* of the magnetic resin body 40 (the first surface 1*a*) or the outer shape of the magnetic resin body 40 or the coil component 1 is symmetric with respect to a point or a line, i.e., when the directionality cannot be determined on the bottom surface of the coil component 1, this is particularly effective.

At least one of the first external terminal 11, the second external terminal 12, and all the dummy terminals 15, 16 may be different from the shape of the other terminals, and a plurality of different shapes or three or more different shapes may be included as long as a direction can be determined as a whole.

According to the coil component 1, the respective shapes of the first external terminal 11, the second external terminal 12, and all the dummy terminals 15, 16 on the outer circumferential side of the magnetic resin body 40 are the same as each other. It is expected that when the coil component 1 is mounted on the mounting board 120, or due to a change in environment after the mounting, the stress applied to the terminals is mainly applied to the outer circumferential sides of the terminals. Therefore, since the shapes are the same in the portions to which the stress is mainly applied in this configuration, the applied stress can be made uniform and the inclination of the coil component 1 relative to the mounting board 120 can be suppressed. Even when an external pressure is applied to the coil component 1 after the mounting on the mounting board 120, the stress applied to the terminals can be made uniform and, therefore, the fixation strength of the coil component 1 to the mounting board 120 can be ensured.

According to the coil component 1, since the first external terminal 11, the second external terminal 12, and all the dummy terminals 15, 16 are disposed on only the one surface 42*a* of the magnetic resin body 40, all the terminals can be accommodated on the one surface 42*a* of the magnetic resin body 40. As a result, when all the terminals 11, 12, 15, 16 are fixed by solder to the mounting board 120, wetting and spreading of the solder can be suppressed on the lateral sides of the coil component 1 and, consequently, the mounting area of the coil component 1 can be reduced.

According to the coil component 1, since the first external terminal 11, the second external terminal 12, the same-shaped dummy terminal 15, and the different-shaped dummy terminal 16 are the four terminals respectively located at the four corners of the magnetic resin body 40, the stress applied to the terminals can be made uniform when the coil component 1 is mounted on the mounting board 120, and the inclination of the coil component 1 relative to the mounting board 120 can be suppressed. Additionally, since the stress applied to the terminals can be made uniform, the fixation strength of the coil component 1 to the mounting board 120 can be ensured.

Four terminals out of the first external terminal 11, the second external terminal 12, and all the dummy terminals 15, 16 may respectively be located at the four corners of the magnetic resin body 40, and the same effects can be produced also in this case.

According to the coil component 1, since the dummy terminals 15 are disposed between the terminals 11, 12, 15, 16 located at the four corners on the two pairs of the opposite sides of the outer shape of the magnetic resin body 40, the mounting strength of the coil component 1 to the mounting board 120 is improved.

The dummy terminals 15 may be disposed between the terminals located at the four corners on at least one pair of opposite sides of the outer shape of the magnetic resin body 40.

According to the coil component 1, since the first external terminal 11 and the second external terminal 12 are located on the same side 45*a* of the outer shape of the magnetic resin body 40, routing wirings connected to the first and second external terminals 12 can be shortened on the mounting board 120. As a result, the mounting board 120 can be made smaller.

The present disclosure is not limited to the embodiments and may be changed in design without departing from the spirit of the present disclosure.

Although the magnetic resin body is disposed also in the inner diameter hole part of the insulating resin body in the embodiments, this is not a limitation and the magnetic resin body may be disposed on the first surface side of the coil conductor without being disposed on the second surface side of the coil conductor. In this configuration, the coil component may warp due to a difference in the thermal expansion coefficient described above. In this case, although the stress applied to the external terminals becomes larger, the coil component 1 can alleviate the stress applied to the external terminals because of including the dummy terminals along with the external terminals. As described above, the configuration of the coil component 1 has a further advantageous effect when the warpage occurs in the component.

Although two layers of coil conductors are disposed as the coil component in the embodiments, one layer or three or more layers of the coil conductors may be disposed.

Although one coil conductor is disposed for each layer for the coil component in the embodiments, a plurality of coil conductors may be disposed for each layer.

Although the coil conductors of the coil component are formed into a planar spiral shape in the embodiments, the coil conductors may be formed into a cylindrical spiral shape.

Although the coil substrate is formed on one of the two surfaces of the base in the embodiments, the coil substrates may respectively be formed on the respective two surfaces of the base. As a result, higher productivity can be achieved.

Although the coil component is used for the thickness detection apparatus in the embodiments, the coil component may be used for any apparatus detecting a distance to a detected conductor, or may be used for an apparatus other than such an apparatus. The manufacturing method of the coil component is not limited to the embodiment.

Although the respective areas of the first external terminal, the second external terminal, and all the dummy terminals are the same as each other in the embodiments, the area of at least one terminal may be different from the areas of the other terminals.

Although the shape of at least one of the first external terminal, the second external terminal, and all the dummy terminals is different from the shape of the other terminals in the embodiments, the respective shapes of all the terminals may be different from each other.

Although the respective shapes of the first external terminal, the second external terminal, and all the dummy terminals on the outer circumferential side of the magnetic resin body are the same as each other in the embodiments, the shape of at least one terminal on the outer circumferential side may be different from the shape of the other terminals on the outer circumferential side.

Although the outer shape of the magnetic resin body is a quadrangle when viewed in the direction orthogonal to the first surface in the embodiments, the shape may be a triangle, a polygon with five or more sides, a circle, an ellipse, etc. In this case, all the terminals may be arranged along the outer shape of the magnetic resin body when viewed in the direction orthogonal to the first surface. Although the magnetic resin body is configured to entirely cover the first surface side of the coil component in the embodiments, this is not a limitation and the magnetic resin body may be configured to partially cover the first surface side. However, the magnetic resin body entirely covering the first surface as in the embodiments is preferable because the magnetic flux leakage from the first surface side can be reduced. Additionally, the magnetic resin body entirely covering the first surface as in the embodiments is preferable because the external terminals and the dummy terminals can be arranged in an increased region and a degree of freedom of terminal arrangement therefore increases. Particularly, when the magnetic resin body entirely covers the first surface as in the embodiments, the warpage of the coil component described above may become lager, and the effect of including the dummy terminals is more effectively produced.

Although four terminals out of the first external terminal, the second external terminal, and all the dummy terminals are respectively located at the four corners of the magnetic resin body in the embodiments, at least one of the four terminals may be located at any of the four corners of the magnetic resin body, or none of the four terminals may be located at the four corners of the magnetic resin body.

Although the first external terminal and the second external terminal are located on the same side of the outer shape of the magnetic resin body in the embodiments, the terminals may be located on different sides of the outer shape of the magnetic resin body.

Example

Figure 6:
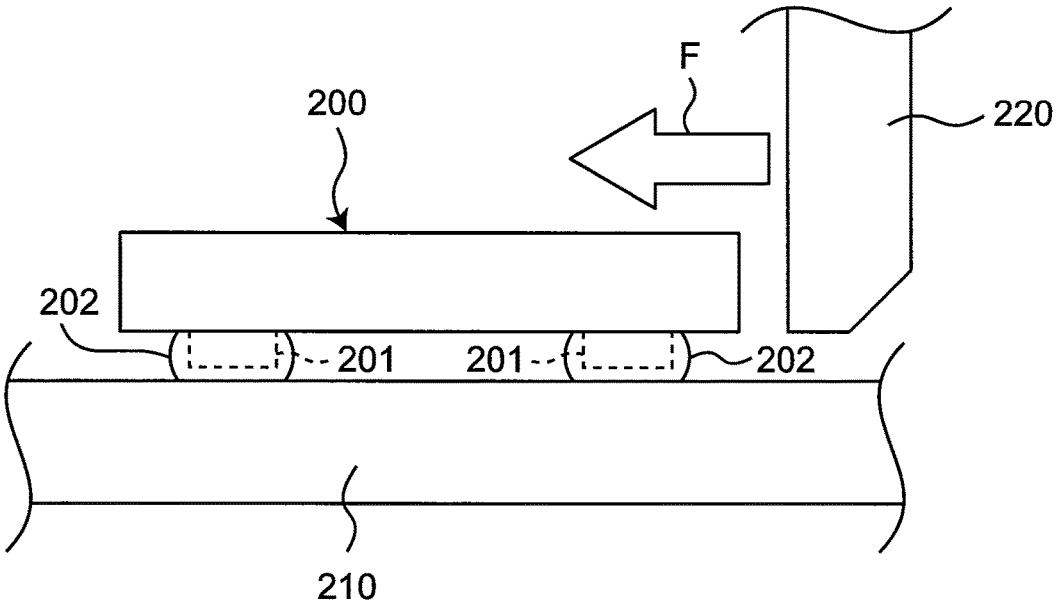
FIG. 6 is an explanatory view for explaining a test of fixation strength of the coil component.

A relationship between the number of terminals of the coil component and the fixation strength of the coil component to the mounting board will be described. As shown in FIG. 6, terminals 201 of a coil component 200 were bonded by solders 202 to a mounting board 210. The terminals 201 correspond to the terminals 11, 12, 15, 16 of the embodiment. The coil component 200 was then pressed by a pushing jig 220 in a direction (direction of an arrow F) parallel to a mounting surface of the mounting board 210. In this way, an occurrence rate of peeling of the coil component 200 from the mounting board 210 (hereinafter referred to as a chip peeling occurrence rate) was examined. In this examination, the pressing speed of the pushing jig 220 was set to 0.5 mm/s.

Figure 7A:
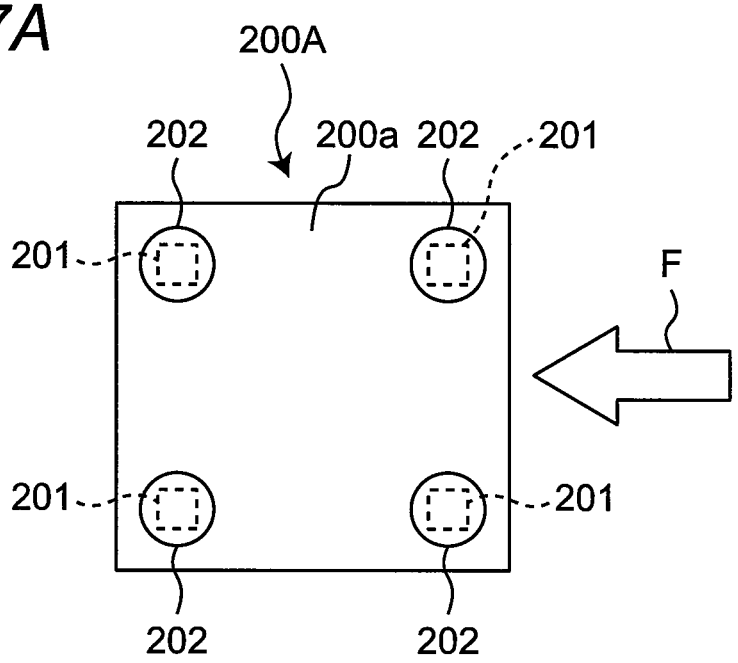
FIG. 7A is a plane view of a four-terminal coil component.
Figure 7B:
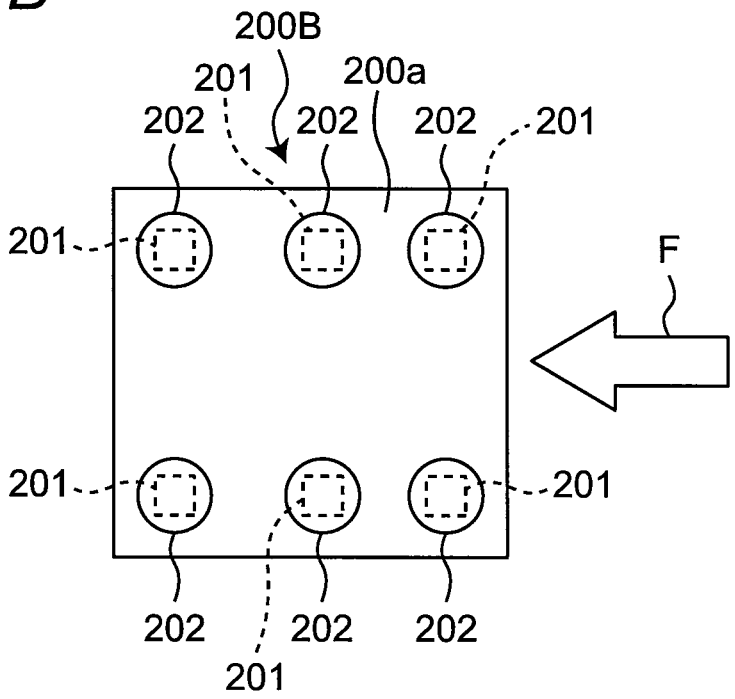
FIG. 7B is a plane view of a six-terminal coil component.

For the coil component 200, a four-terminal coil component 200A having the four terminals 201 disposed on a bottom surface 200*a* as shown in FIG. 7A and a six-terminal coil component 200B having the six terminals 201 disposed on the bottom surface 200*a* as shown in FIG. 7B were used. The bottom surface 200*a* corresponds to the one surface 42*a* of the magnetic resin body 40 of the embodiment.

Figure 8:
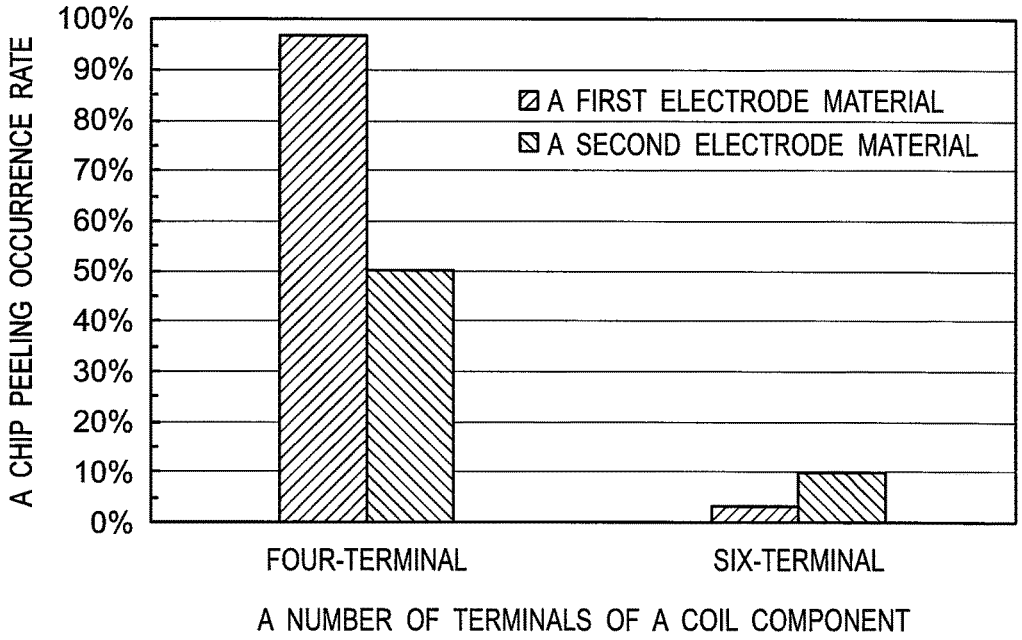
FIG. 8 is a graph of a relationship between the number of terminals of the coil component and a chip peeling occurrence rate.

As a result, as shown in FIG. 8, the six-terminal coil component 200B was reduced in the chip peeling occurrence rate as compared to the four-terminal coil component 200A. Therefore, it was found that an increase in the number of terminals results in an improvement in the strength of the terminals and a reduction in chip peeling.

For the material of the terminals, a first electrode material and a second electrode material were used. The first electrode material is a conductive resin having a metal filler contained in an epoxy resin, and the second electrode material is a conductive resin having a metal filler contained in an epoxy resin and a phenol resin. For both the first and second electrode materials, a six-terminal chip peeling occurrence rate was reduced as compared to a four-terminal chip peeling occurrence rate.

The invention claimed is:

1. A coil component having a first surface and a second surface opposing each other, comprising:

a coil conductor formed into a spiral shape;

an insulating resin body entirely surrounding the coil conductor;

a magnetic resin body disposed over a first surface side of the coil conductor without being disposed on a second surface side of the coil conductor;

a first external terminal and a second external terminal disposed on at least one surface of the magnetic resin body on a first surface side of the magnetic resin body and electrically connected to the coil conductor; and at least one dummy terminal disposed on at least the one surface of the magnetic resin body on the first surface side of the magnetic resin body without being electrically connected to the coil conductor, wherein a surface of the insulating resin body on a first surface side of the insulating resin body is in contact with the magnetic resin body, and a surface of the insulating resin body on a second surface side of the insulating resin body is exposed to an exterior of the coil component.

2. The coil component according to claim 1, wherein the magnetic resin body is disposed over an entire surface of the coil conductor on the first surface side of the coil conductor.

3. The coil component according to claim 1, wherein the first surface is a mounting surface that is a side at which the coil component is mounted on a mounting board, and the second surface is a detecting surface that is a side facing a detected conductor.

4. The coil component according to claim 1, wherein when viewed in a direction orthogonal to the first surface, a gravity center of the first surface is included in a region formed by connecting respective gravity centers of the first external terminal, the second external terminal, and every dummy terminal.

5. The coil component according to claim 1, wherein when viewed in a direction orthogonal to the first surface, the first external terminal, the second external terminal, and every dummy terminal are located outside the inner surface of the coil conductor.

6. The coil component according to claim 1, wherein when viewed in a direction orthogonal to the first surface, the first external terminal, the second external terminal, and every dummy terminal have a sum of areas of portions located outside an outer surface of the coil conductor larger than a sum of areas located inside the outer surface of the coil conductor.

7. The coil component according to claim 1, wherein when viewed in a direction orthogonal to the first surface, the respective areas of the first external terminal, the second external terminal, and every dummy terminal are the same as each other.

8. The coil component according to claim 1, wherein when viewed in a direction orthogonal to the first surface, a shape of at least one of the first external terminal, the second external terminal, and every dummy terminal is different from a shape of the other of the first external terminal, the second external terminal, and every dummy terminal.

9. The coil component according to claim 1, wherein when viewed in a direction orthogonal to the first surface, respective shapes of the first external terminal, the second external terminal, and every dummy terminal on an outer circumferential side of the first surface are the same as each other.

10. The coil component according to claim 1, wherein the first external terminal, the second external terminal, and every dummy terminal are disposed on only the one surface of the magnetic resin body.

11. The coil component according to claim 1, wherein the number of the dummy terminals is at least two, when viewed in a direction orthogonal to the first surface, a shape of an outer circumference of the first surface is a quadrangle, and four terminals out of the first external terminal, the second external terminal, and all the dummy terminals are respectively located at four corners of the first surface.

12. The coil component according to claim 11, wherein the dummy terminals are disposed between the terminals located at the four corners on at least one pair of opposite sides of the outer circumference of the first surface.

13. The coil component according to claim 11, wherein the first external terminal and the second external terminal are located on the same side of the outer circumference of the first surface.

* * * * *